United States Patent [19]

Kerwin et al.

[11] 4,287,016

[45] Sep. 1, 1981

[54] MACHINE FOR APPLYING INDICIA TO TENNIS BALL FELTS

[75] Inventors: Daniel Kerwin, Lombard; Victor Trentadue, Arlington Heights, both of Ill.

[73] Assignee: The Meyercord Co., Carol Stream, Ill.

[21] Appl. No.: 925,812

[22] Filed: Jul. 18, 1978

[51] Int. Cl.[3] ..... B65C 9/02; B65H 3/08; B65H 3/34

[52] U.S. Cl. ..... 156/497; 156/542; 156/566; 156/571; 156/DIG. 25; 271/102; 271/104; 271/107; 271/132; 271/212; 414/32; 414/127; 414/128

[58] Field of Search ..... 156/542, 572, 571, DIG. 29, 156/DIG. 31, 521, 566, 569, 384, 497, DIG. 25, 557; 271/102, 104, 132, 133, 137, 107, 212; 414/32, 70, 82, 125, 126, 128, 127

[56] References Cited

U.S. PATENT DOCUMENTS

| | | | |
|---|---|---|---|
| 995,018 | 6/1911 | Kent | 271/35 |
| 996,012 | 6/1911 | Franke | 271/99 |
| 1,413,181 | 4/1922 | Muller | 271/1 |
| 1,522,717 | 1/1925 | Frost | 271/102 |
| 1,960,667 | 5/1934 | Hutt et al. | 271/212 |
| 2,102,132 | 12/1937 | Schmidtke | 156/542 |
| 2,391,694 | 12/1945 | Everett | 156/571 |
| 2,749,120 | 6/1956 | Mallory | 271/212 |
| 2,808,766 | 10/1957 | Larson | 271/102 X |
| 2,811,352 | 10/1957 | Bornemann | 271/102 |
| 2,914,322 | 11/1959 | Engleson et al. | 271/101 |
| 3,007,698 | 11/1961 | MacDonald et al. | 271/212 |
| 3,026,109 | 3/1962 | Pfeffer, Jr. | 271/99 |
| 3,294,259 | 12/1966 | Puhm | 414/126 |
| 3,335,699 | 8/1967 | Aiken et al. | 118/76 |
| 3,341,390 | 9/1967 | Kirk | 156/521 |
| 3,396,857 | 8/1968 | Brown | 414/46 |
| 3,616,093 | 10/1971 | Teed | 156/571 |
| 3,910,811 | 10/1975 | Paxton et al. | 156/521 |
| 3,938,675 | 2/1976 | Rees | 414/41 |
| 4,024,963 | 5/1977 | Hautau | 414/52 |
| 4,068,767 | 1/1978 | Tippetts | 414/32 |
| 4,135,710 | 1/1979 | Seragnoli | 414/128 |

FOREIGN PATENT DOCUMENTS 245042 5/1963 Australia .

*Primary Examiner*—Michael G. Wityshyn
*Attorney, Agent, or Firm*—Merriam, Marshall & Bicknell

[57] ABSTRACT

This disclosure relates to a machine for applying indicia, preferably decalcomanias (decals), to felts that form part of tennis balls. A stack of the felts is placed in the machine, and a destacking mechanism separates each felt from the stack and places them on a conveyor which moves the felts to a decal applicating machine. After a decal is applied to each felt, the conveyor moves the felts to a restacking mechanism which lifts the felts off the conveyor and restacks them. The machine is preferably equipped to handle the felts in pairs in order to double the speed of operation.

8 Claims, 18 Drawing Figures

4
4
41
42
14
6
6
43
66
44
52
28
28
23
11
22
21a
26
53
22a

FIG-14
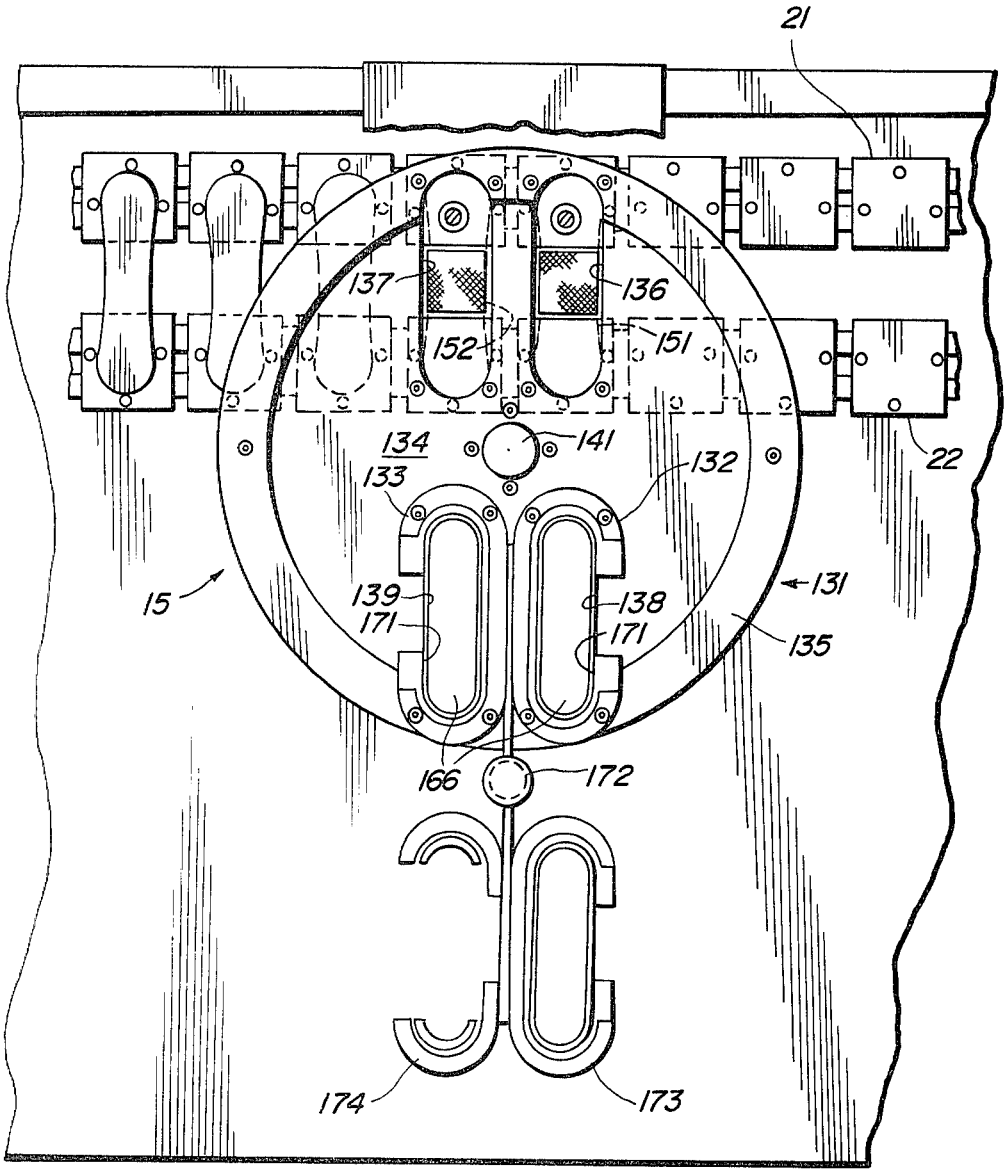
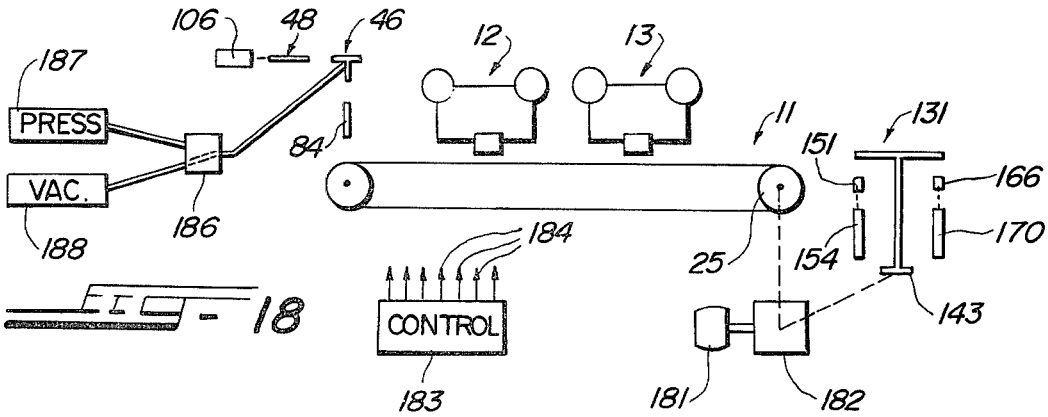
FIG-18

MACHINE FOR APPLYING INDICIA TO TENNIS BALL FELTS

It is common practice to place a company name or a trademark on tennis balls, and it has been customary in the past to place such a marking on the balls after they have been completely assembled. This process has been somewhat slow and cumbersome, however, because of the requirements that the decals must be applied to a round surface and that the seams of the balls must be avoided.

It is a general object of the present invention to provide apparatus for processing tennis ball felts and for applying decals to felts while in flat form.

Apparatus in accordance with the present invention comprises a conveyor having an input end and a removal end. A destacking mechanism places felts on the conveyor at the input end and a restacking mechanism at the removal end removes the felts from the conveyor and restacks them. At least one applicator is provided between the input and removal ends for applying decals to the felts while they are on the conveyor.

The destacking mechanism includes means for supporting a stack of felts, a movable knife for separating the lowermost felt from the remainder of the stack, and a vacuum head for supporting the lowermost felt during the separating operation and for transferring a separated felt to the conveyor.

The restacking mechanism includes a rotatable shuttle, means for removing the felts from the conveyor and for placing the felts in the shuttle, a restacking magazine, and means for removing the felts from the shuttle and stacking them in the restacking magazine.

The foregoing and other objects and advantages of the present invention will become apparent from the following detailed description taken in conjunction with the accompanying figures of the drawings, wherein:

FIG. 14 is a sectional view taken on the line 14—14 of FIG. 13;

FIG. 18 is a diagrammatic view of a power and control mechanism of the machine.

Figure 1:
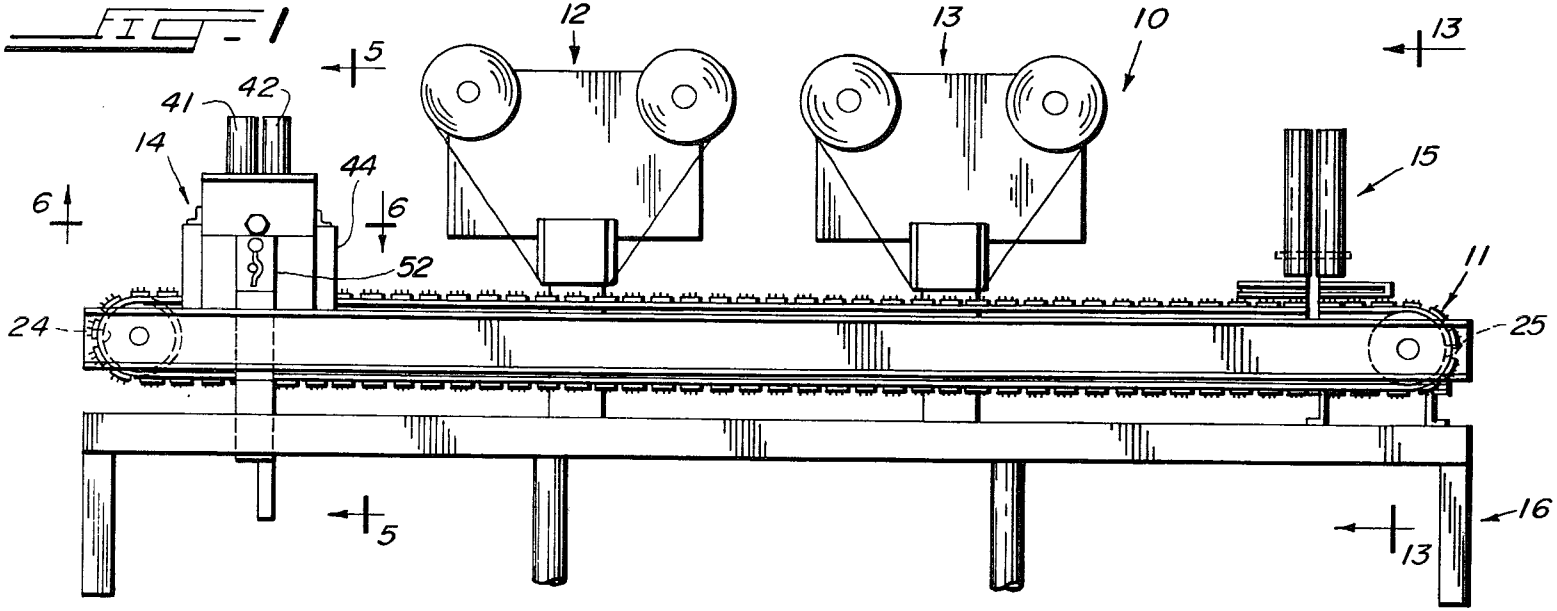
FIG. 1 is a side elevational view of a machine in accordance with the present invention.
Figure 2:
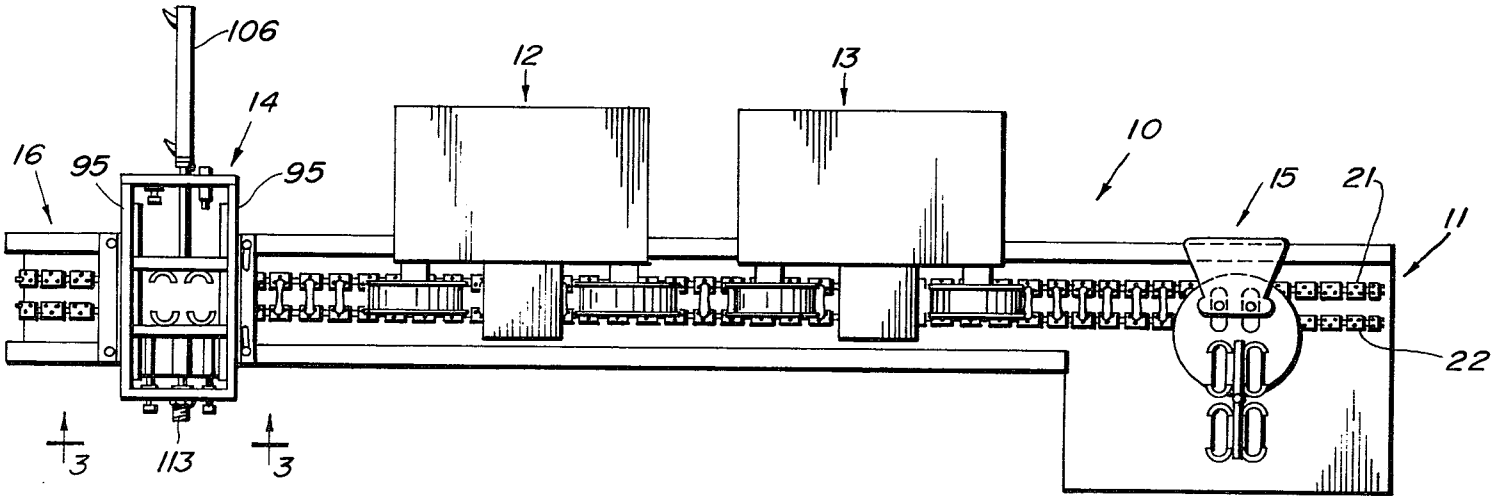
FIG. 2 is a top plan view of the machine shown in FIG. 1.

With reference to FIGS. 1 and 2 of the drawings, the machine is indicated generally by the reference numeral 10 and is designed to apply decals to tennis ball felts. The machine 10 includes an endless conveyor 11 for moving tennis ball felt past two decal applicators 12 and 13, a destacking mechanism 14 for separating felts from stacks of felts and placing the felts on the input end of the conveyor 11, and a restacking mechanism 15 for removing the felts from the removal end of the conveyor 11 and stacking them in magazines of the restacking mechanism 15. The machine 10 further includes a frame 16 for supporting the various operating parts, and a drive mechanism (to be described later) for driving the various parts in synchronism. The construction of the frame 16 may be conventional in nature and does not form part of the present invention. While the machine 10 may be constructed to handle the felts one at a time, it is preferred that the machine be designed, as illustrated in the drawings, to handle the felts in pairs in order to double the speed of operation.

The machine operation, briefly stated, is that the drive mechanism moves the conveyor 11 in the clockwise direction as seen in FIG. 1 in an intermittent type of motion. Each time the conveyor 11 is stationary, the following events occur: the applicators 12 and 13 place decals on felts which are in proper positions in front of the machines, the destacking mechanism 14 places two felts in side-by-side relation on the conveyor 11, and the restacking mechanism removes two felts from the conveyor 11 and stacks them in magazines of the restacking mechanism. After the foregoing events occur, the drive mechanism moves the conveyor 11 forwardly, which is in the clockwise direction, a distance equal to two decals on the conveyor 11, and then stops again while the previously described events occur once again in the next cycle.

Figure 3:
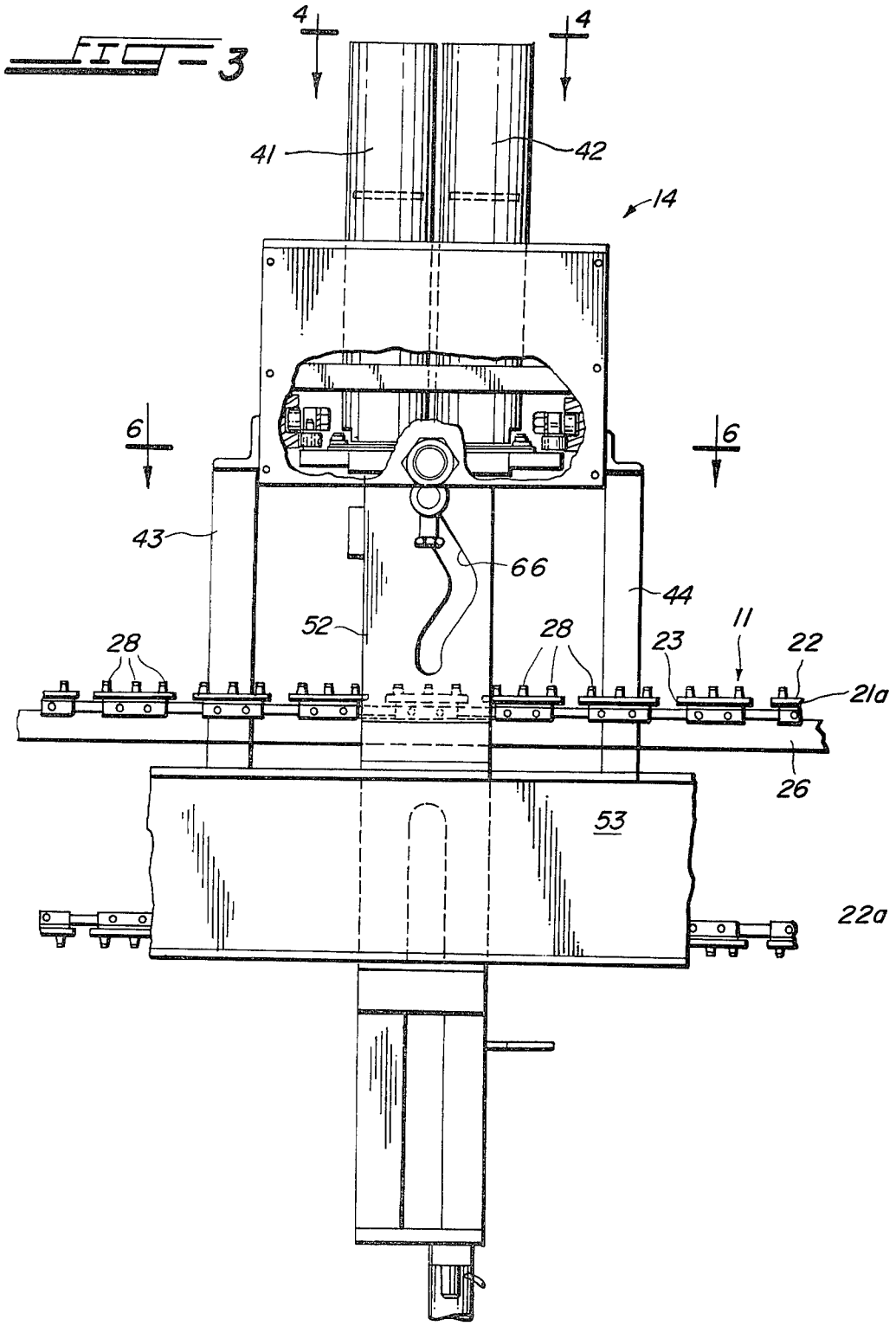
FIG. 3 is a fragmentary enlarged view on the line 3—3 of FIG. 2, showing a destacking mechanism of the machine shown in FIG. 1.
Figure 4:
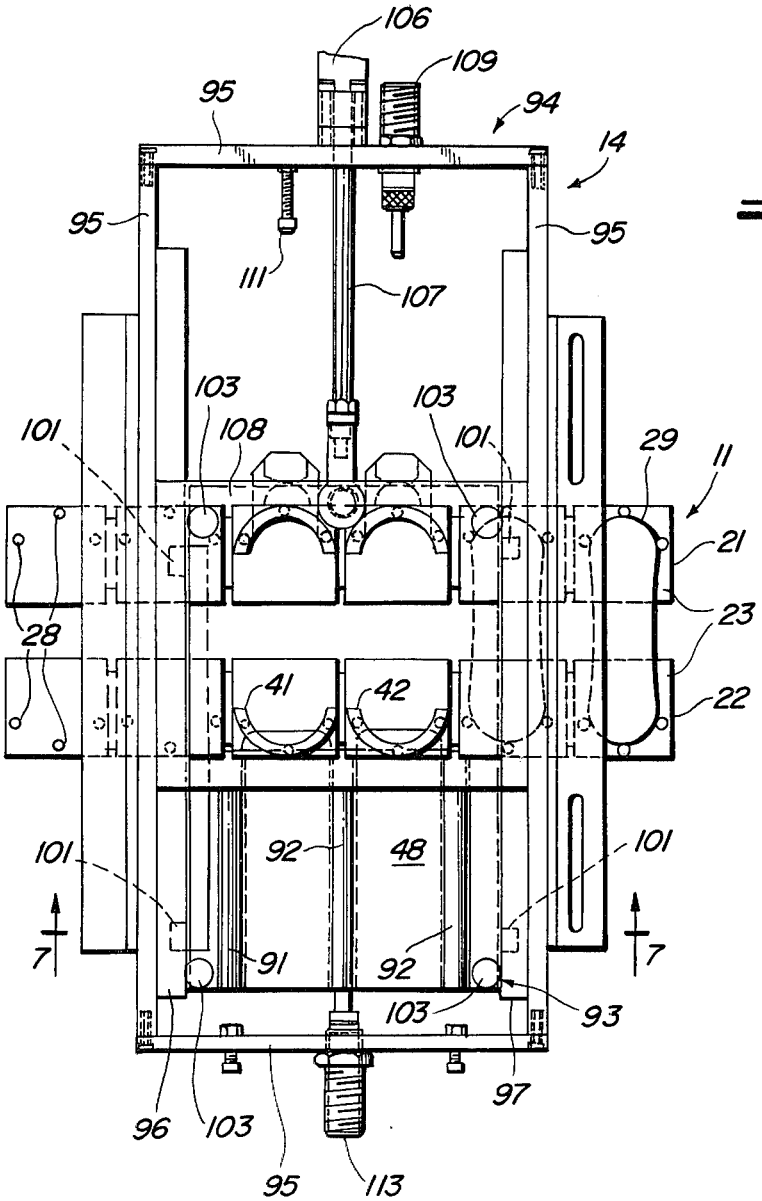
FIG. 4 is a fragmentary view taken on the line 4—4 of FIG. 3.
Figure 5:
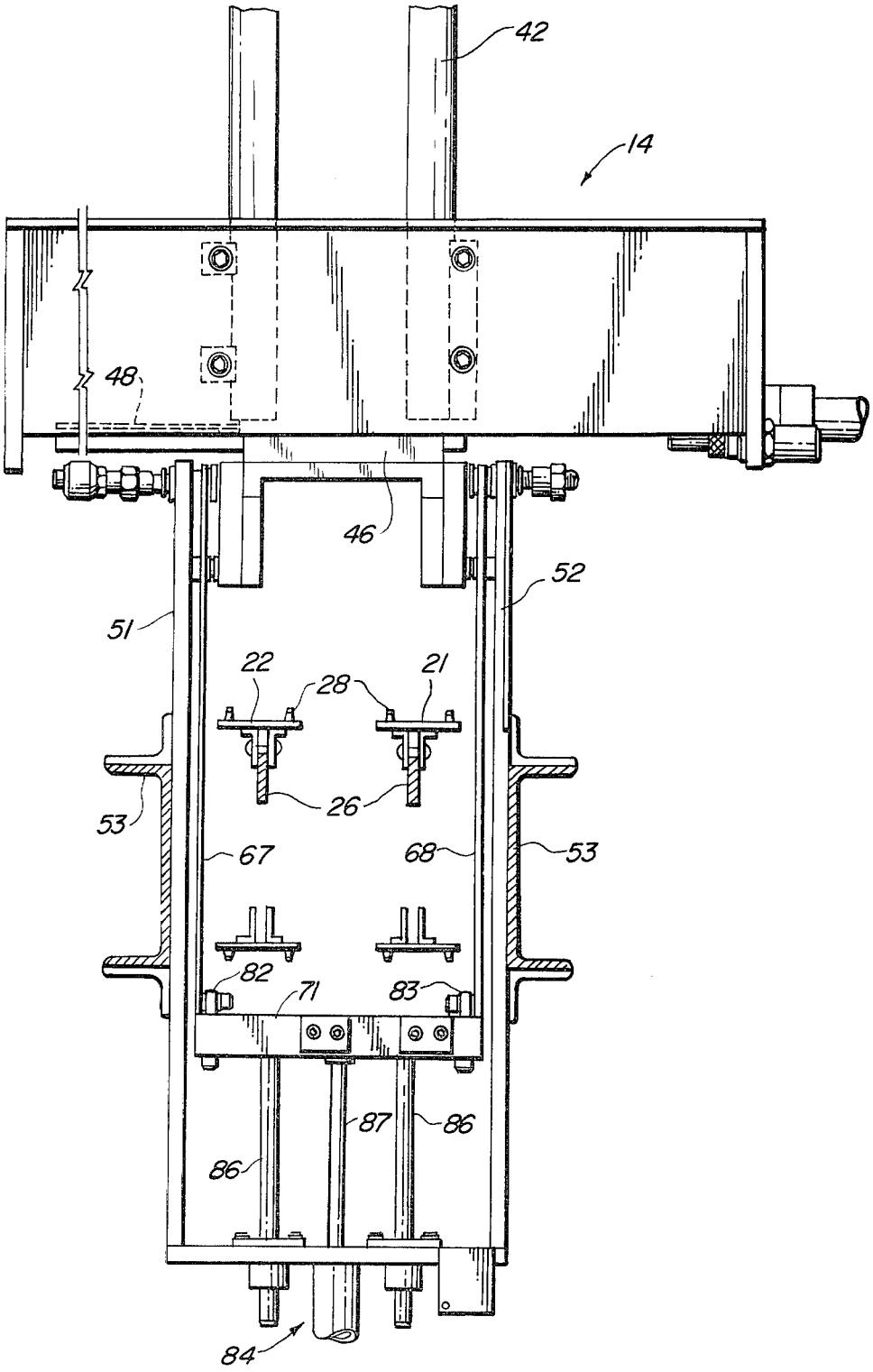
FIG. 5 is a sectional view taken on the line 5—5 of FIG. 1.

The conveyor 11 is best illustrated in FIGS. 2 through 5, and it includes two side-by-side link chain sections 21 and 22. Each of the sections 21 and 22 consists of a series of substantially square plates 23 which are linked together, and the two sections 21 and 22 are trained around two sprockets 24 and 25 at the opposite ends of the machine. The sprockets 24 and 25 are intermittently driven in order to move the chains 21 and 22 clockwise, as previously mentioned. As is best shown in FIGS. 3 and 5, the upper runs **21*a* and 22*a* of the chain sections slide on stationary vertically elongated bars 26 which support the upper runs 21*a* and 22*a*** so that they will not sag while the decals are being applied to the felts.

On the outer side of each of the square plates 23 is provided a plurality of guide pins 28. The pins 28 on each of the plates 23 are spaced apart around the laterally outer edges so that a felt, indicated by the reference numeral 29 in FIG. 4, may be received between the pins 28 of an associated pair of the plates 23. The pins 28 hold the felts in place on the plates during movement of the conveyor.

The destacking mechanism 14 is shown in greater detail in FIGS. 3 through 8, and includes two vertically extending magazines 41 and 42, each of which is shaped to receive a stack of the felts 29. As is well known to those skilled in this art, one side of each felt 29 is coated with an adhesive compound and the opposite side is covered with a fuzzy material. The felts 29 are stacked in the magazines with the fuzzy sides facing downwardly, and the felts in each stack are slightly glued together because they are stacked before the adhesive is completely dry. The adhesive coated side is vulcanized to the outer surface of an inner sphere after leaving the machine 10, to form a tennis ball. During the manufacture of the tennis ball felts, the adhesive is applied to one side of a large sheet of the felt material and usually about five of the large sheets are stacked one on top of the other, and the stacked sheets are fed through a stamping machine which cuts out the felts. As mentioned, the adhesive is usually not completely dry when the large sheets are stacked, this wetness of the adhesive plus the pressure applied on the sheets at the time that the felts are cut causes the felts to stick together. As will be described in detail hereinafter and in accordance with this invention, the destacking mechanism 14 in accordance with the present invention separates the felts even though they may be stuck together.

As previously mentioned, the two magazines 41 and 42 are mounted above the conveyor 21 as is best shown in FIGS. 3 and 5. The two magazines 41 and 42 are fastened to and are supported by vertically extending bars 43 and 44 (FIG. 3) which are supported by frame members of the machine. Movably mounted below the lower ends of the two magazines 41 and 42 are two heads or paddles 46 and 47 (FIGS. 5, 6 and 8), and a blade 48. The two heads 46 and 47 are movable from a first or upper position (shown in FIG. 5) where the upper surfaces of the two heads face upwardly and engage the lowermost felts of the stacks in the two magazines 41 and 42, and a second or lower position (FIG. 12) where the two heads 46 and 47 have been pivoted 180° and spaced downwardly and where they place the separated felts on the conveyor 21. During the time that the heads 46 and 47 are in the upper position, they support the two stacks of felts, and a vacuum holds the lowermost felts firm while the lowermost felts are being separated from the stacks by the blade 48. During the time that the two heads 46 and 47 are downwardly displaced away from the stacks, the stacks are supported by the blade 48.

Figure 8:
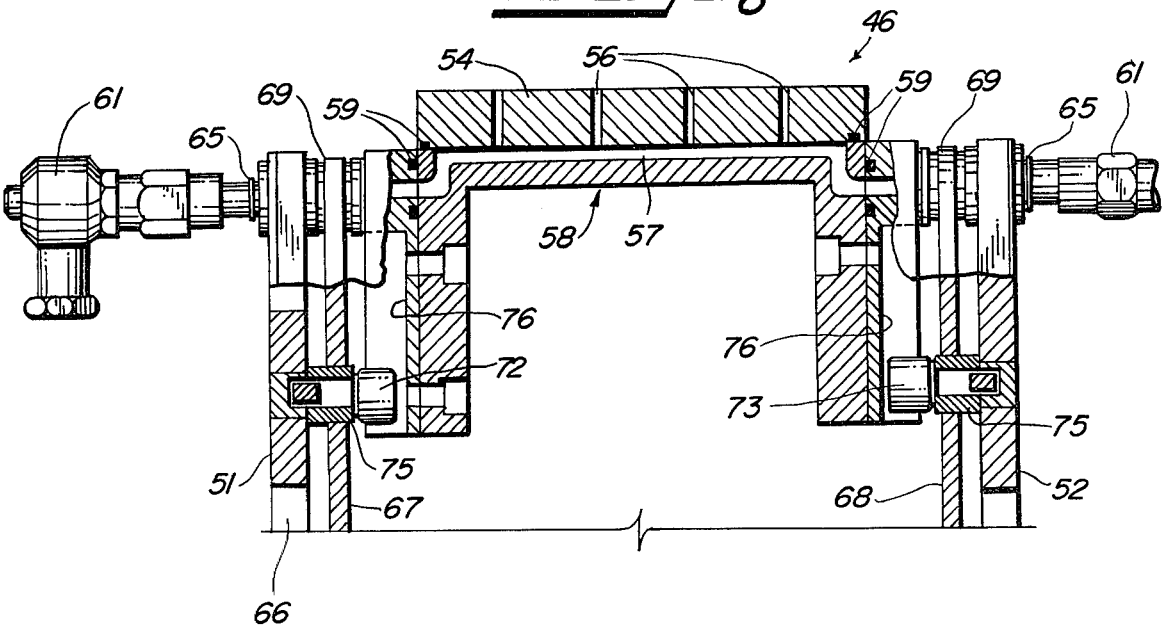
FIG. 8 is a fragmentary view partially in section of part of the destacking mechanism.

The two heads 46 and 47 are supported for vertical and pivotal movement by two vertically extending stationary plates 51 and 52 (FIGS. 3 and 5) which in turn are supported by channels 53 of the frame 16. With specific reference to FIG. 8 which shows the head 46, the head comprises a flat plate 54 having a plurality of holes 56 formed through it, and the underside of the plate 54 is a channel or air passage 57 formed in a U-shaped head support 58. The holes 56 in the plate 54 are in flow communication with the passage 57 and seals 59 are provided to seal the connections to the passage 57. At each end of the support 58 is provided a coupling 61 which connects an air hose to the passage 57. The couplings 61 connect with tubes 65 that extend through slots 66 (FIGS. 3 and 9 through 12) formed in the two side plates 51 and 52. The tubes 65 are sized to slide and pivot within the slots 66. Further connected to the two tubes 65 are two bars 67 and 68 located at the opposite sides of the head support 58, between the support 58 and the two plates 51 and 52. The upper ends of the bars 67 and 68 are pivotably connected to the two tubes 65 in the area indicated at 69, and the two bars 67 and 68 extend downwardly from the support 58. With reference to FIG. 5, the lower ends of the two bars 67 and 68 are connected to a crossbar 71 which forms part of a carriage for moving the heads 46 and 47 upwardly and downwardly. The bar 71 is located substantially straight below the two heads 46 and 47, and the two bars 67 and 68 are curved adjacent their upper ends so that they will clear lower two pivot connections 72 and 73 (FIGS. 5 and 8), the curvature of the two bars 67 and 68 being indicated in FIG. 6 by the reference numeral 74. With specific reference to FIG. 8, the pivot rollers 72 and 73 engage the vertical legs of the support 58, and the two rollers 72 and 73 are rotatably mounted as indicated at 75 on the two plates 51 and 52. The two rollers 72 and 73 extend into elongated slots 76 formed in the two vertical legs of the support 58, the two slots 76 extending vertically and being below the two tubes 65 when the heads 46 and 47 are in the uppermost position as shown in FIGS. 8 and 9.

Figure 6:
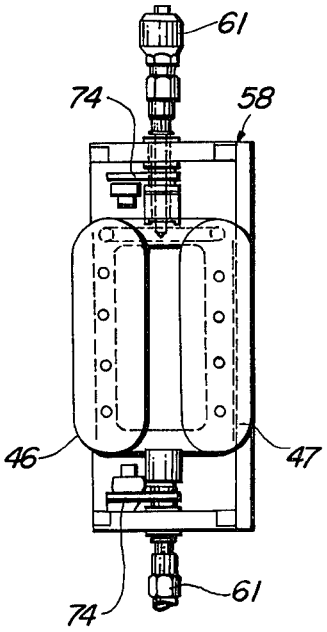
FIG. 6 is a sectional view taken on the line 6—6 of FIG. 3.
Figure 9:
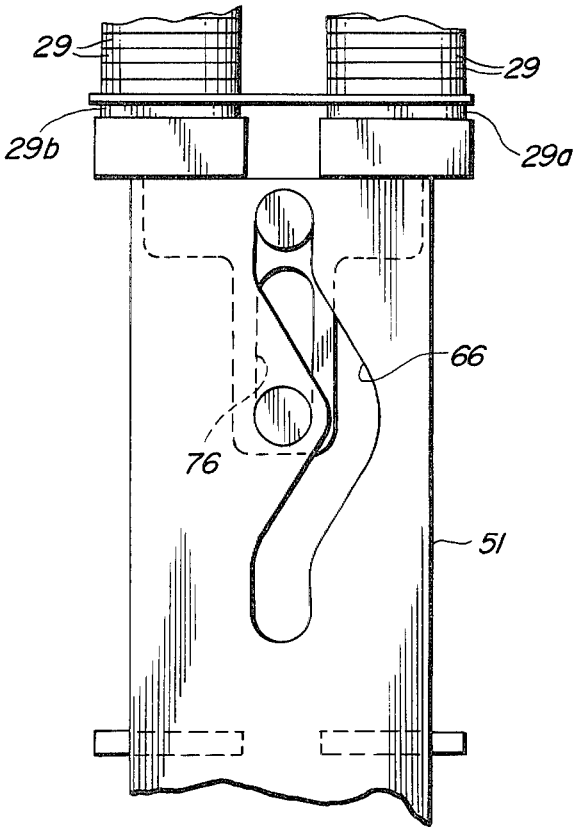
FIGS. 9 through 12 are views illustrating the operation of the destacking mechanism.
Figure 10:
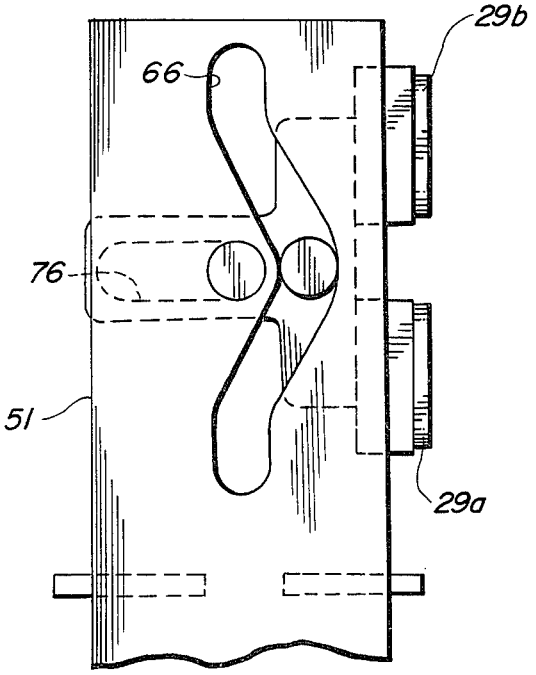
Figure 11:
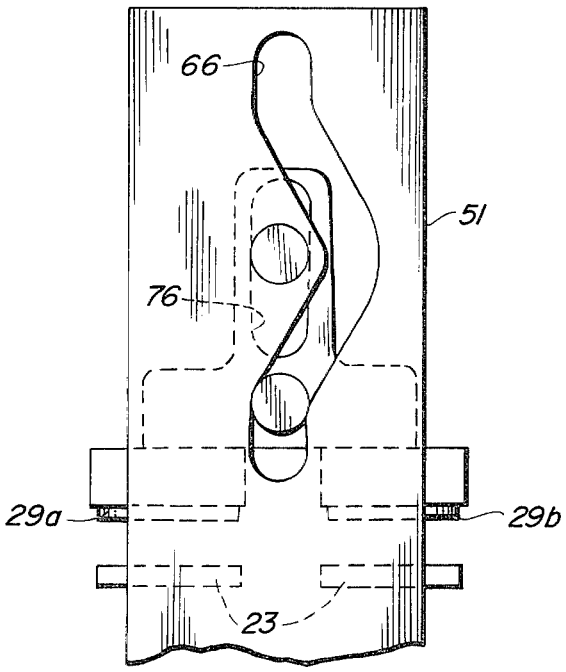
Figure 12:
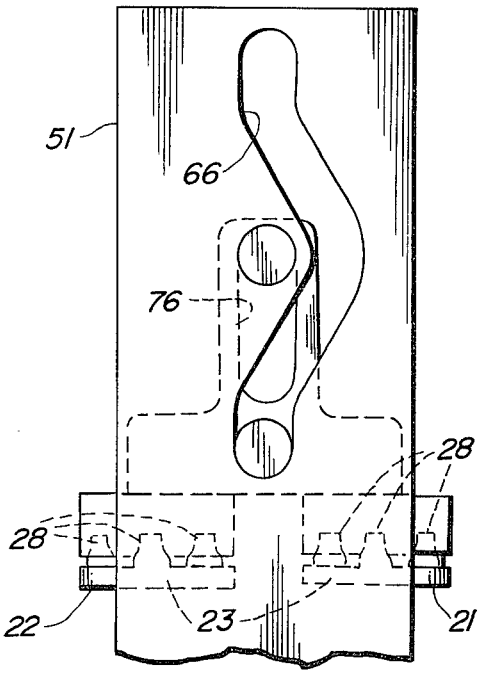

With reference to FIGS. 3 and 9 through 12, the slot 66 formed in each of the vertically extending plates 51 and 52 is vertically elongated and curves around the pivot roller supports 74. Assuming that the heads 46 and 47 are initially in their upper positions as shown in FIGS. 8 and 9, when the two bars 67 and 68 are pulled downwardly due to downward movement of the crossbar 71, the tubes 65 are moved downwardly in the slots 66 while, at the same time, the support 58 pivots about the rollers 72 and 73. The heads 46 and 47 swing through a 180° arc as the tubes 65 are moved from the upper ends of the slots 66 to the lower end of the slots, and the rollers 72 and 73 both turn and move longitudinally in the slots 76 of the support 58 during this turning movement as shown in FIGS. 9 to 12. When the bars 67 and 68 are in their uppermost positions as shown in FIGS. 5, 8 and 9, the two heads 46 and 47, which are both carried by the support 58 as shown in FIG. 6, are in the upper positions and face the undersides of the two magazines. As shown in FIG. 9, the heads engage the lowermost felts, indicated by the reference numerals **29*a* and 29*b*, of the stacks in the two magazines 41 and 42. As the two bars 67 and 68 are moved downwardly, the heads 46 and 47 are pivoted 180° and face downwardly and are directly over the two sections 21 and 22 of the conveyor 11. This position is shown in FIG. 12. At this time, the control for the air supply to the tubes 65 is adjusted to release the felts 29*a* and 29*b*, and this is preferably done by applying a slight positive air pressure within the passage 57 and the holes 56 in order to push the felts off of the heads and onto the conveyor plates between the guide pins 28. After the felts have been released by the heads, the bars 67 and 68 are moved upwardly again in order to pivot the heads in the reverse direction and to return them to the position shown in FIG. 9**.

During the time that the heads 46 and 47 are displaced downwardly, the stacks in the two magazines are supported by the blade 48. As soon as the heads have been returned to the upper position, the blade 81 is retracted and the two stacks of felts shift downwardly by gravitational force and are once again supported by the two heads. At approximately this time, the vacuum is again applied to the passage 57 and to the holes 56 in order to securely hold the lowermost felts of the two stacks.

With specific reference to FIG. 5, the two bars 67 and 68 are connected to the cross bar 71 by two pivotable connections indicated at 82 and 83. The bar 71 is moved vertically, as seen in FIG. 5, by an air cylinder 84. Two guide rods 86 guide the movement of the bar 71 as the bar 71 is moved in a reciprocating motion by the piston rod 87 of the air cylinder 84. The two pivotal connections 82 and 83 permit the two bars 67 and 68 to pivot slightly as the two tubes 65 follow the curvature of the slots 66.

Figure 7:
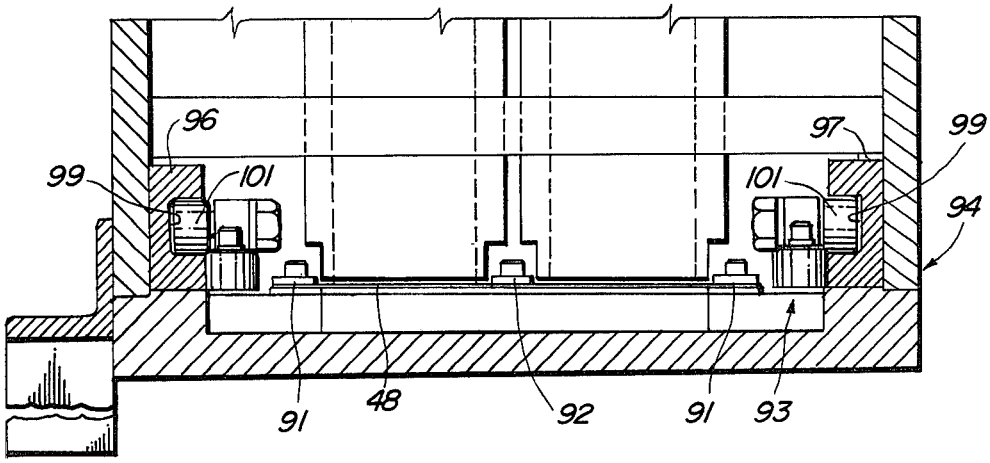
FIG. 7 is a further enlarged sectional view taken on the line 7—7 of FIG. 4.

The blade 48 is in a horizontal plane and is located just below the lower ends of the two magazines 41 and 42 and just above the level of the upper sides of the heads 46 and 47 when the heads are in their uppermost positions. With reference to FIGS. 3, 4 and 7, the blade 48 consists of one broad blade having a width approximately equal to the dimension across the two magazines. At its side edges and at the center, the blade is supported by three straps 91 and 92 on a carriage 93. The carriage 93 is movably mounted in a rectangular frame 94 formed by four side members 95, and the frame 94 further includes two tracks 96 and 97. With reference to FIGS. 4 and 7, the two tracks 96 and 97 have horizontally extending slots 99 formed in their sides which are adjacent the blade 48, and two pairs of rollers 101 fastened to the four corners of the carriage 93 and fit in the slots 99. The axes of the rollers 101 are horizontally disposed and the rollers support the carriage as will be apparent from FIG. 7. Four additional rollers 103 at the corners of the carriage 93 engage the vertical sides of the tracks 96 and 97, and the rollers 103 prevent horizontal movement laterally as seen in FIG. 7.

Thus, the carriage is mounted for rolling movement on the tracks 96 and 97 and the carriage including the blade 48 is moved by an air cylinder 106 (FIG. 4). The cylinder 106 is fastened to a side 95 of the rectangular frame 94 and the piston rod 107 of the cylinder 106 is fastened to a bar 108 that forms part of the carriage 93. Thus, actuation of the air cylinder 106 moves the rod 107 in a reciprocating movement and results in the carriage 93 moving between a retracted position shown in FIG. 4 and an extended position where the blade 48 is underneath the two stacks of the felts in the magazine as shown in FIG. 9. With reference to FIG. 4, in the extended position the blade 48 is displaced upwardly and is below the two magazines 41 and 42.

Also mounted on a member 95 of the frame 94 is a shock absorber 109 and a stop 111 which respectively cushions the stop of the carriage and forms a final stop at the extended position. At the opposite end of the frame 94, another member 95 supports another shock absorber 113 that cushions the stop of the carriage when the carriage reaches the retracted position.

In operation, when the carriage is in the retracted position, shown in FIG. 4, the blade 48 is displaced to one side of the magazines 41 and 42, the two heads 46 and 47 are in their upper position immediately below the two magazines, and the two stacks of felts are supported on the upper surfaces of the two heads 46 and 47. At this time, a partial vacuum is applied to the two couplings 61 and 62 and the lowermost felts **29*a* and 29*b* of the two stacks are firmly held by the vacuum in the two heads. The air cylinder 106 is then actuated to move the blade 48 from the retracted position to the extended position, and the blade 48 moves between the lowermost felts 29*a* and 29*b* and the next adjacent felts. As will be apparent from FIG. 9, the spacing of the blade 48 above the two heads 46 and 47 is approximately equal to the thickness of the felts 29*a* and 29*b* so that the blade moves through the two stacks just immediately above the two lowermost felts. The leading edge of the blade is relatively sharp and the movement of the blade separates the two lowermost felts from the other felts, and after the blade has moved through the two stacks, the stacks are supported by the blade 48 which is then held in the extended position. As previously mentioned, it is frequently the case that the felts of the stacks are held together by the adhesive, and the blade 48 serves to break the hold of the adhesive, or to sever the lowermost felts from the other felts. The partial vacuum existing in the passages 57 and the holes 56 of the two heads firmly holds the two lowermost felts 29*a* and 29*b* during this separating operation so that the lowermost felts are not wrinkled or folded by the movement of the blade through the two stacks. After the blade 48 has moved through the two stacks and separated the lowermost felts, the two heads are pivoted 180° and moved downwardly as previously described and transfer the two felts to the conveyor. During this head movement the blade 48 supports the stacks as previously mentioned. After the felts have been transferred to the conveyor, the heads are moved upwardly again and the blade 48 is retracted, permitting the two stacks of felts to shift downwardly until they are again supported on top of the two heads 46 and 47**, thereby completing a cycle of operation. The foregoing cycle is continuously repeated during the operation of the machine.

As previously mentioned, after the decals have been applied to the felts, the felts are removed from the conveyor 11 and they are restacked by the restacking mechanism 15 which is better shown in the FIGS. 13 to 17. The restacking mechanism includes a pivotable shuttle 131 which has one side extending above the two conveyor sections 21 and 22, and the opposite side extending below a pair of vertically extending magazines 132 and 133. The shuttle 131 includes a lower circular plate 134 having four openings 136 through 139 formed therein, the openings 136 and 137 being formed in side by side relation at one side of the plate 134 and the other two openings 138 and 139 being similarly formed but 180° displaced from the openings 136 and 137. An upper annular member 135 is secured to the plate 134 by braces 140 and stiffens the plate 134. The shuttle 131 is rotatably supported by a vertical post or shaft 141 which is rotatably mounted on a plate 142 that forms part of the machine frame 16. The lower end of the shaft 141 is connected to the output of a drive mechanism 146 and is connected to turn the shaft 141 and the shuttle 131. The power input shaft 147 of the mechanism 146 is connected to a drive sprocket 148 which is driven from the main drive of the machine. The mechanism 146 intermittently turns the shaft 141 and the shuttle 131 through an angle of 180°, between one position where the openings 136 and 137 (FIG. 14) are over a pair felts on the conveyor 11 and the openings 138 and 139 are underneath the magazines 132 and 133, and a second position where the openings 138 and 139 are over the conveyor 11 and the openings 136 and 137 are under the magazines 132 and 133.

Figure 13:
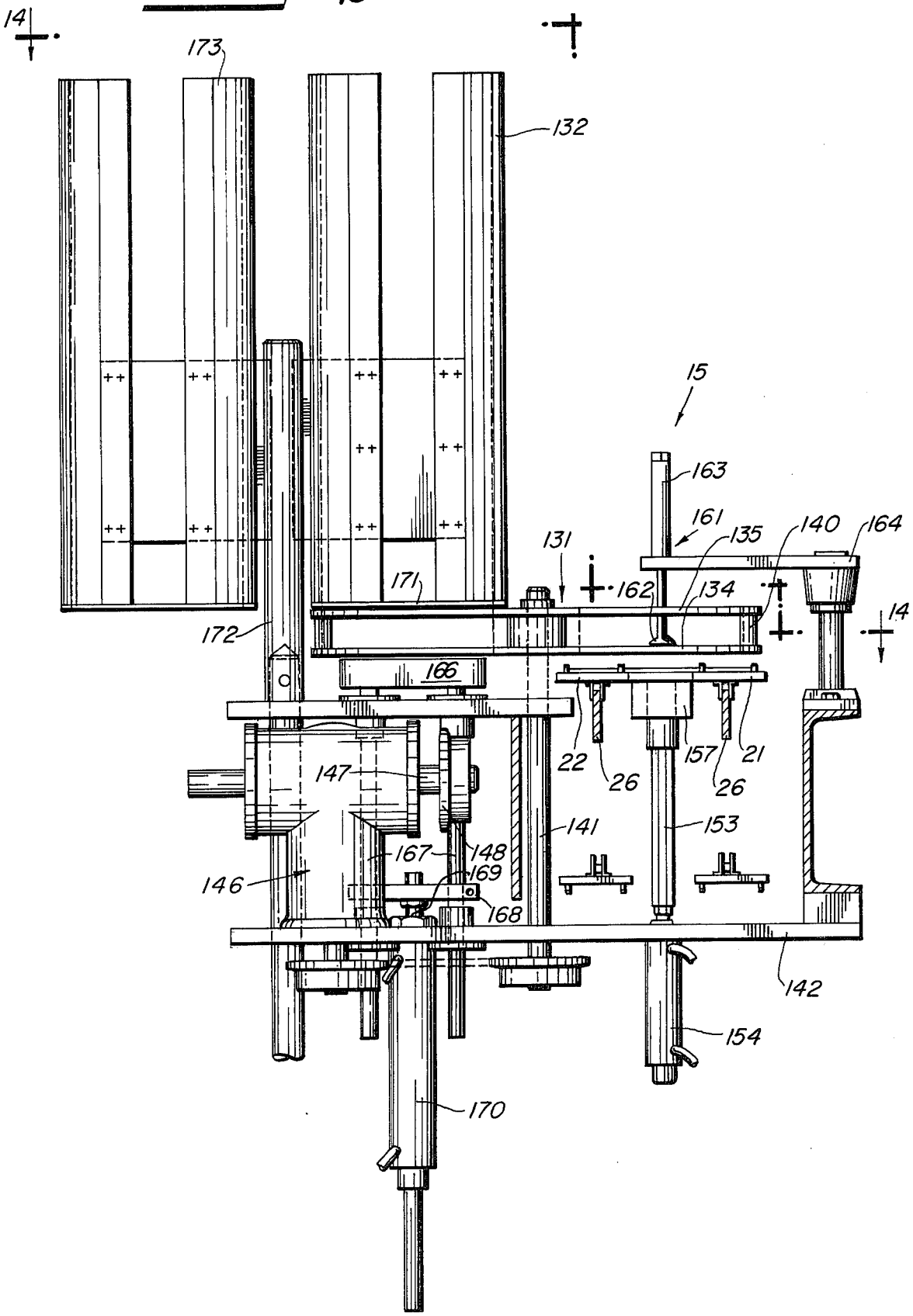
FIG. 13 is a view taken on the line 13—13 of FIG. 1 and showing a restacking mechanism of the machine.
Figure 15:
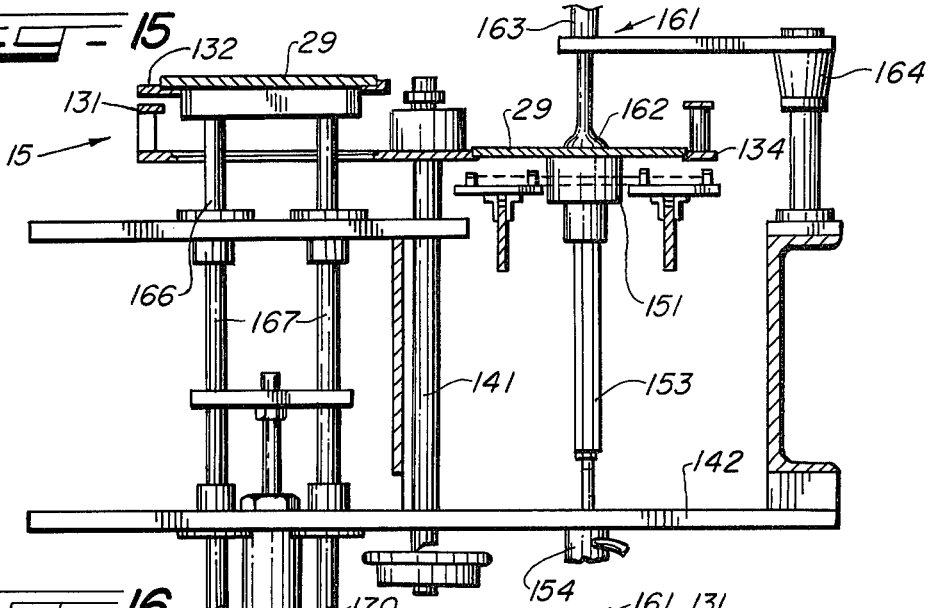
FIGS. 15 through 17 are views illustrating the operation of the restacking mechanism shown on FIGS. 13 and 14.
Figure 16:
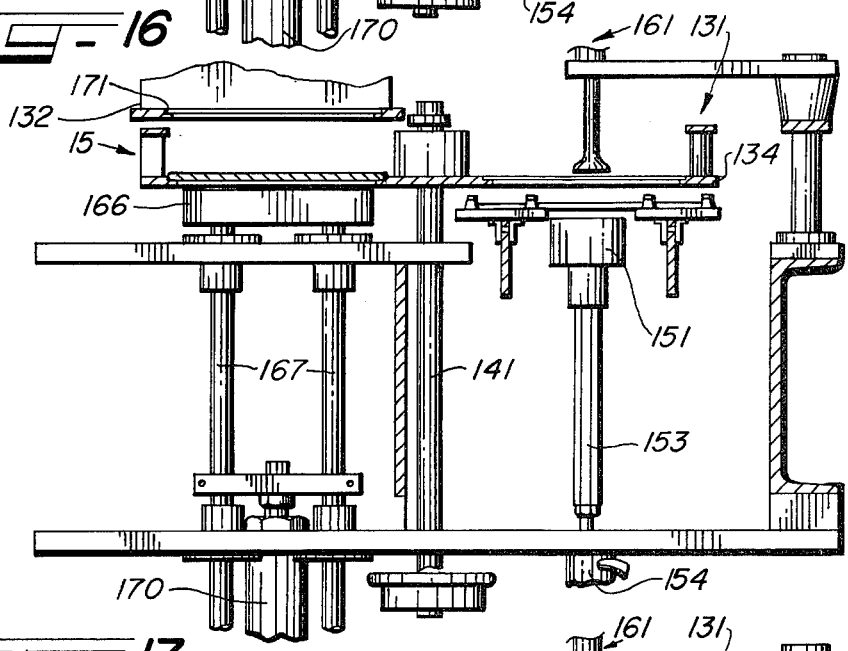
Figure 17:
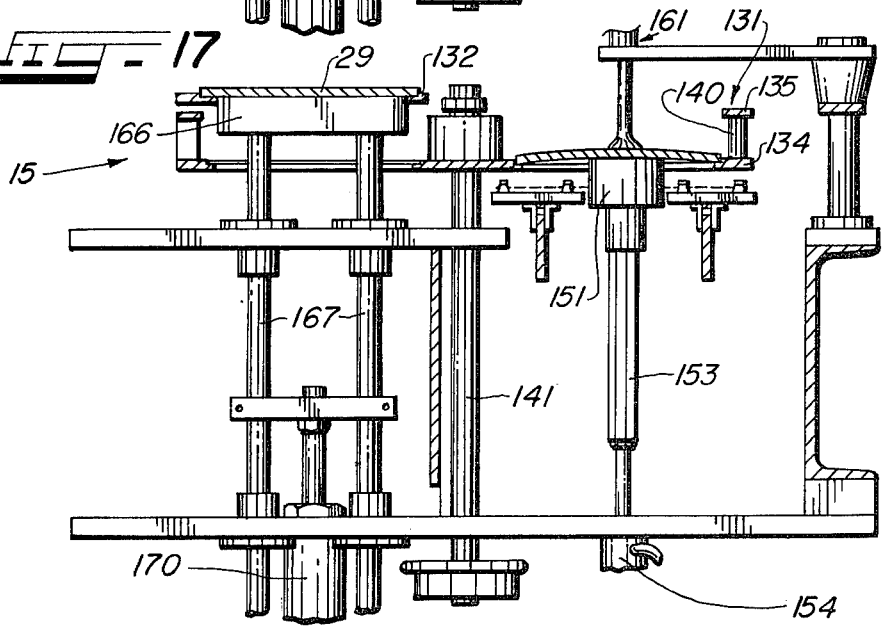

The restacking mechanism further includes a pair of pusher or lift pads 151 and 152 which are located below the shuttle openings 136 and 137. The two lift pads 151 and 152, as shown in FIGS. 13 and 14, are substantially square in cross section and fit between the two sections 21 and 22 of the conveyor. The pads 151 and 152 are mounted on the upper end of a lift shaft 153 which is operated by an air cylinder 154. The shaft 153 supports the two pads 151 and 152 and alternately moves the pads 151 and 152 in a reciprocating motion between a lower position, shown in FIG. 13, and an upward position shown in FIG. 15, where the upper surfaces of the two pads 151 and 152 are above the level of the lower plate 134 of the shuttle 131. When the pads 151 and 152 are moved upwardly, they push two felts upwardly off of the conveyor and through the openings 136 and 137. The size of the openings 136 and 137 is slightly smaller than the outer dimensions of the felts, and when the pads 151 and 152 are subsequently lowered, the edges of the felts rest on the margins of the openings 136 and 137 and the felts are held while the blocks 151 and 152 move downwardly.

It is preferred that a pressure pad be associated with each of the pads 151 and 152, and such pads are indicated by the numeral 161 in FIGS. 13 and 15 to 17. Each of the pads 161 includes a member 162 that normally extends downwardly to a level which is just above the upper surface of the lower plate 134 as shown in FIG. 13. When the shaft 153 and the pads 151 and 152 move upwardly, the pressure pads 162 rest on the upper surfaces of the two felts and hold the felts steady on the two pads 151 and 152, thereby preventing the felts from being thrown out of the proper position. The pressure pads 162 are part of rods which extend into air cylinders 163 and cushion the movements of the members 162. The air cylinders 163 and the pressure members 162 are supported by a crossbrace 164 shown in FIG. 13.

After two felts have been lifted by the two pads 151 and 152 and deposited on the upper surfaces of the plate 134 at the openings 136 and 137, the machine drive turns the shaft 141 and the shuttle 131 through an angle of 180° and stops. At this position, the openings 136 and 137 with the felts therein, are below the two magazines 132 and 133 and the openings 138 and 139 are now located above the two blocks 151 and 152. While the magazine is turning, the conveyor 11 moves forwardly the distance of two felts. The next two felts are then removed from the conveyor in the manner previously explained. At the time that the rod 153 and the two pads 151 and 152 are raised, another lift mechanism raises two felts out of the openings 136 and 137 and into the lower ends of the two magazines 132 and 133. This last lift mechanism includes a pair of pads 166 mounted below the two magazines 132 and 133 on two rods 167. A cross brace 168 supports the rods 167 and is connected to the piston rod 169 of an air cylinder 170 which moves the pads 166 up and down in an intermittent reciprocating movement. Again, the edges of the felts are caught or engaged by the margins of the openings 171 at the lower ends of the two magazines 132 and 133, and consequently when the pads are withdrawn downwardly, the margins of the openings 171 at the lower ends of the magazines holds the stack of felts in the magazine.

The two magazines 132 and 133 are supported by a support shaft 172 which also supports a second pair of magazines 173 and 174. After the two magazines 132 and 133 have been substantially filled with felts, the machine is stopped and the shaft 172 is rotated through a 180° angle so that the other two magazines 132 and 133 can be emptied while the magazines 173 and 174 are being filled.

FIG. 18 illustrates a power and control system of the machine. An electric motor 181 drives an intermittent movement type of mechanism 182 such as a Ferguson movement. The conveyor 11 and the shuttle 131 are connected to be operated by the mechanism 182. The four air cylinders 84, 106, 154 and 170 are connected to a control device 183 having a plurality of outlets 184. The two applicators 12 and 13 and an air switch 186 are also connected to the outlets 186. The switch 186 connects either an air pressure supply 187 or a vacuum supply 188 to the couplings 61 of the heads 46. The control 183 may be connected to be actuated in each cycle of operation by the mechanism 182 directly or from a cam or limit switch, for example, operated by a moving part of the machine.

Assume that the mechanism 182 has just completed the movement of the conveyor 11 one step forward and the shuttle 131 has rotated 180°. As soon as the conveyor stops, the applicators 12 and 13 are actuated to apply decals to two felts. The air switch 186 connects the vacuum 188 to the heads 46 which hold the lowermost felts **29*a* and 29*b* of the two stacks, the cylinder 106 then moves the blade 48 forward to separate the felts, the heads 46 are moved downwardly by the cylinder 84 to transfer the felts to the conveyor 11, the heads 46 move up again, and the blade 48 retracts. When the head is just above the conveyor 11, the switch 186 moves to connect the pressure supply 187 to the head in order to push the decals off the heads. During the foregoing events, the members 151 and 166 are moved upwardly to transfer two felts from the conveyor to the shuttle 132 and to transfer two felts from the shuttle to the magazines 132 and 133. Then the conveyor 11 is advanced and the shuttle 131** is turned to start a new cycle.

The mechanism 182 includes a speed reducer between the motor 181 and the Furgeson mechanism, and the Ferguson mechanism is arranged, for example, so that, in each 360° cycle of its input shaft, the output shaft will turn during 90° of the cycle and will remain stationary for 270°. While the operation has been described wherein a number of operations take place while the conveyor is stationary, some could be started while the conveyor is still moving. For example, the blade 48 could start to move as the conveyor is stopping.

The restacking mechanism 15 may include means for automatically turning the shaft 172 and the four magazines 132, 133, 173 and 174. For example, a counter may be provided to count machine cycles and actuate a mechanism for turning the shaft 172 after a certain number of felts have been pushed into the magazines.

The applicators 12 and 13 may be of the character shown in U.S. Pat. No. 3,813,268. As shown in FIG. 1, there are an odd number of pairs of plates 23 of the conveyor 11, with felts thereon, between the two applicators 12 and 13, so that the applicators will operate on alternate felts. This feature of course enables the machine to process two felts simultaneously as previously mentioned.

What is claimed is:

1. A machine for applying indicia to tennis ball felts while the felts are in flat form, each of said felts including a fuzzy side and an opposite side having a mastic coating thereon, said coating tending to adhere adjacent felts of said stack, comprising at least one applicator for applying an indicium to a fuzzy side of a felt, an intermittently moving conveyor for moving a series of felts to and past said applicator in intermittent start and stop movement, a destacking mechanism adjacent one end of said conveyor including a magazine adapted to receive and support said stack of felts, a movable head mounted at the lower open end of the stack, said head including a flat surface and air means for holding a felt on said flat surface, means for moving said head generally vertically between an upper position where said flat surface engages the lower side of the lowermost felt of said stack and supports said stack and said air means attaching said lowermost felt to said head, and a lower position where said head is spaced downwardly from said stack and places said felts on said conveyor during a stop portion of said movement, blade means movably mounted between said head and said stack, means for moving said blade through said stack to separate said lowermost felt from the remainder of said stack and then to retract said blade, said blade further supporting said stack when said head is not in said upper position, said air means producing a partial vacuum to hold a felt while said blade is moving through said stack and while said head is moving from said upper position to said lower position, a restacking mechanism adjacent the other end of said conveyor for removing said felts from said conveyor and restacking said felts during a stop portion of said movement, and means on said conveyor for holding said series of felts at regularly spaced positions during said intermittent movement, said holding means being oriented with said destacking and restacking mechanisms and with said applicator whereby respective holding means are simultaneously adjacent said destacking and restacking mechanisms and said applicator, and said mechanisms and said applicator operating simultaneously during said stop portions of said movement.

2. A machine according to claim 1, wherein two of said applicators are provided, said destacking mechanism including means for simultaneously separating felts from two stacks of felts and placing said two on said conveyor, and said restacking mechanism including means for simultaneously removing two felts from said conveyor and restacking said felts in two stacks.

3. Apparatus according to claim 1, wherein said head moving means moves said head through substantially 180° to a position closely above the conveyor.

4. Apparatus according to claim 3, wherein said air means produces air pressure in said head when said head is closely above the conveyor.

5. A restacking mechanism for use in a machine for applying indicia to a series of felts carried by an intermittently movable conveyor, said felts being in a substantially horizontal plane while on said conveyor, said mechanism comprising a shuttle, means for supporting said shuttle and for pivoting said shuttle on a substantially vertical axis, said shuttle having one side extending over said conveyor and a second side displaced from said conveyor, a magazine mounted above said displaced side, first pusher means for lifting felts off of said conveyor and placing said felts in said shuttle, and second pusher means for lifting said felts off of said shuttle and placing said felts in said magazine.

6. A mechanism according to claim 5 wherein said conveyor has two spaced sections, and said first pusher means extends between said two sections.

7. A mechanism according to claim 5, wherein said shuttle has an opening therein slightly smaller than the size of said felts, said first pusher means pushing the felts through said opening, and the margin of said opening engaging and supporting the felts.

8. A mechanism according to claim 5, wherein said shuttle has an opening in said one side and another opening in said second side, and said first and second pusher means operating substantially simultaneously to place a felt in said one opening and to remove a felt from said other opening.

* * * * *